US009666112B2

(12) United States Patent
Kim

(10) Patent No.: US 9,666,112 B2
(45) Date of Patent: May 30, 2017

(54) DISPLAY PANEL WITH REPAIR LINES AND DISPLAY DEVICE INCLUDING THE SAME

(71) Applicant: SAMSUNG DISPLAY CO., LTD., Yongin, Gyeonggi-Do (KR)

(72) Inventor: Jin-Woo Kim, Hwaseong-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 86 days.

(21) Appl. No.: 14/557,816

(22) Filed: Dec. 2, 2014

(65) Prior Publication Data

US 2015/0379908 A1 Dec. 31, 2015

(30) Foreign Application Priority Data

Jun. 27, 2014 (KR) ..... 10-2014-0079460

(51) Int. Cl.
*G09G 3/00* (2006.01)

(52) U.S. Cl.
CPC ..... *G09G 3/006* (2013.01); *G09G 2300/043* (2013.01); *G09G 2300/0413* (2013.01); *G09G 2330/08* (2013.01); *G09G 2330/10* (2013.01)

(58) Field of Classification Search
CPC ... G09G 2300/0413; G09G 2300/0426; G09G 2330/10
See application file for complete search history.

(56) References Cited

U.S. PATENT DOCUMENTS 6,943,374 B1 * 9/2005 Park ..... G02F 1/1309 257/347
2006/0077313 A1 4/2006 Liu et al.
2007/0040794 A1 * 2/2007 Kwak ..... G02F 1/136259 345/100
2008/0169822 A1 7/2008 Kwak
2009/0167730 A1 * 7/2009 Kwak ..... G09G 3/3688 345/204
2010/0149162 A1 6/2010 Park et al.
2011/0069061 A1 * 3/2011 Nakamura ..... G09G 3/3225 345/214
2012/0126781 A1 5/2012 Narayanan et al.
2013/0176194 A1 7/2013 Jin et al.
2014/0132487 A1 * 5/2014 Park ..... G02F 1/13454 345/55
2015/0179678 A1 * 6/2015 Xu ..... H01L 27/1244 345/93

FOREIGN PATENT DOCUMENTS

EP 2383720 A2 11/2011
KR 10-0833755 B1 5/2008

* cited by examiner

*Primary Examiner* — Andrew Sasinowski
*Assistant Examiner* — Chun-Nan Lin
(74) *Attorney, Agent, or Firm* — Lee & Morse P.C.

(57) ABSTRACT

A display panel includes data lines and scan lines extending from a peripheral region to a display region, a plurality of data pads, and a plurality of dummy pads. First voltage lines extend from the peripheral region to the display region, and are connected to pixel circuits to provide a first voltage to light emitting devices. The display panel also has a repair line group including at least one first repair line and a plurality of second repair lines. The at least one first repair line has an end connected to a first one of the dummy pads in the peripheral region and another end connected to a corresponding one of the first voltage lines at a first position in the display region. The second repair lines are not connected to the dummy pads and the first voltage lines.

20 Claims, 7 Drawing Sheets

DISPLAY PANEL WITH REPAIR LINES AND DISPLAY DEVICE INCLUDING THE SAME

CROSS REFERENCE TO RELATED APPLICATION

Korean Patent Application No. 10-2014-0079460, filed on Jun. 27, 2014, and entitled, "Display Panel and Display Device Including the Same," is incorporated by reference herein in its entirety.

BACKGROUND

1. Field

One or more embodiments described herein relate to a display panel, and a display device including a display panel.

2. Description of the Related Art

A flat panel display has low power consumption, high resolution, and improved image quality. As the resolution and size of the display increases, the size of its pixels is reduced and the number of pixels is increased.

Because the size of each pixel is reduced and the size of the display is increased, a voltage drop (or an IR drop) issue in pixels at a center region of the display has been magnified, which deteriorates the image quality. Further, when a crack occurs in the display (e.g., by physical impact), overcurrent may flow through pixels where the crack exists. The display may be damaged or burned by the overcurrent.

SUMMARY

In accordance with one embodiment, a display panel including a substrate including a peripheral region adjacent a display region; a plurality of data lines extending from the peripheral region to the display region in a first direction; a plurality of scan lines extending from the peripheral region to the display region in a second direction; a pad area including a plurality of data pads and a plurality of dummy pads, the data pads connected to the data lines at the peripheral region; a plurality of pixel circuits in the display region and connected to the data lines and the scan lines; a plurality of light emitting devices respectively connected to the pixel circuits; a plurality of first voltage lines extending from the peripheral region to the display region in a third direction, the first voltage lines connected to the pixel circuits to provide a first voltage to the light emitting devices; and a repair line group including at least one first repair line and a plurality of second repair lines, wherein the at least one first repair line having an end connected to a first one of the dummy pads in the peripheral region and another end connected to a corresponding one of the first voltage lines at a first position in the display region, and wherein the second repair lines are not connected to the dummy pads and the first voltage lines.

The display panel may include a plurality of dummy pixel circuits spaced apart from the pixel circuits, wherein the dummy pixel circuits are adjacent to the at least one first repair line and the second repair lines. The defective pixel circuit may be disconnected from a corresponding one of the light emitting devices, and one of the second repair lines adjacent to the defective pixel circuit may be connected to the corresponding one of the light emitting devices, and may be connected to one of the dummy pixel circuits adjacent to the one of the second repair lines.

When a defective pixel circuit is disconnected from a corresponding one of the light emitting devices, the at least one first repair line may be disconnected from the first one of the dummy pads and the corresponding one of the first voltage lines, is connected to the corresponding one of the light emitting devices, and is connected to one of the dummy pixel circuits adjacent to the at least one first repair line, and one of the second repair lines adjacent to at least one first repair line is connected to the corresponding one of the first voltage lines at a second position in the display region, and is connected to the first one of the dummy pads.

The display panel may include a plurality of second voltage lines extending from the peripheral region to the display region in a fourth direction, the second voltage lines may be connected to the light emitting devices to provide a second voltage to the light emitting devices, wherein the repair line group may include at least one third repair line having an end connected to a second one of the dummy pads at the peripheral region and another end connected to a corresponding one of the second voltage lines at a third position in the display region.

When one of the pixel circuits adjacent to the at least one third repair line is defective and the defective pixel circuit is disconnected from a corresponding one of the light emitting devices, the at least one third repair line may be disconnected from the second one of the dummy pads and the corresponding one of the second voltage lines, may be connected to the corresponding one of the light emitting devices, and may be connected to one of the dummy pixel circuits adjacent to the at least one third repair line, and one of the second repair lines adjacent to at least one third repair line may be connected to the corresponding one of the second voltage lines at a fourth position in the display region, and is connected to the second one of the dummy pads.

A voltage at the first position may be provided to the first one of the dummy pads through the at least one first repair line, and a voltage at the third position may be provided to the second one of the dummy pads through the at least one third repair line. The at least one first repair line, the second repair lines, and the third repair line may be spaced from the data lines, and extend from the peripheral region to the display region in the first direction. The third direction may be equal to the fourth direction, and the first voltage lines may be spaced from the second voltage lines.

In accordance with another embodiment, a display device includes a display panel including: a plurality of data lines extending in a first direction; a plurality of scan lines extending in a second direction; a pad area including a plurality of data pads connected to the data lines, and a plurality of dummy pads; a plurality of pixel circuits connected to the data lines and the scan lines; a plurality of light emitting devices respectively connected to the plurality of pixel circuits; a plurality of first voltage lines connected to the pixel circuits; and a repair line group including at least one first repair line and a plurality of second repair lines, the at least one first repair line having an end connected to a first one of the dummy pads and another end connected to a corresponding one of the first voltage lines at a first position, and the plurality of second repair lines not connected to the dummy pads and the first voltage lines; a panel driver to apply driving signals to the data lines and the scan lines; a power supply to apply a first voltage to the first voltage lines; and a voltage level measuring circuit connected to the dummy pads and the power supply unit, the voltage level measuring circuit to measure a first voltage level of the first voltage from the power supply, and to measure a second voltage level of the first voltage from the first one of the dummy pads.

The display panel may include plurality of dummy pixel circuits spaced apart from the pixel circuits, the dummy pixel circuits may be disposed adjacent to the at least one first repair line and the second repair lines. The voltage level measuring circuit may measure, as the second voltage level of the first voltage, a voltage level of the first voltage at the first position through the at least one first repair line and the first one of the dummy pads.

The voltage level measuring circuit may include an analog-to-digital converter to convert the first voltage level and the second voltage level into first digital data and second digital data, respectively; a memory to store the first digital data and the second digital data; and a microprocessor to read the first digital data and the second digital data from the memory, and to perform predetermined operations on the first digital data and the second digital data.

The microprocessor may generate comparison data by comparing the first digital data corresponding to the first voltage level and the second digital data corresponding to the second voltage level, and may provide the comparison data to the panel driver, the panel driver to compensate the driving signals based on the comparison data.

The microprocessor may calculate a difference value between the first digital data corresponding to the first voltage level and the second digital data corresponding to the second voltage level, and may generate a cut-off signal when the difference value is greater than a predetermined value, and the power supply may stop supplying the first voltage in response to the cut-off signal.

The display panel may include a plurality of second voltage lines to receive a second voltage from the power supply, the second voltage lines connected to the light emitting devices to provide the second voltage to the light emitting devices, the repair line group may include at least one third repair line having an end connected to a second one of the dummy pads and another end connected to a corresponding one of the second voltage lines at a third position.

The voltage level measuring circuit may measure, as a third voltage level of the second voltage, a voltage level of the second voltage at the third position through the at least one third repair line and the second one of the dummy pads. The voltage level measuring circuit may include an analog-to-digital converter to convert the second voltage level and the third voltage level to first digital data and second digital data, respectively; a memory to store the first digital data and the second digital data; and a microprocessor to read the first digital data and the second digital data from the memory, and to perform predetermined operations on the first and the second digital data.

The microprocessor may calculate a difference value between the first digital data corresponding to the second voltage level and the second digital data corresponding to the third voltage level, and may generate a cut-off signal when the difference value is smaller than a predetermined value, and the power supply may stop supplying the first voltage and the second voltage in response to the cut-off signal.

In accordance with one embodiment, a display panel includes a first repair line connected to a dummy pad; a second repair line not connected to the dummy pad; a voltage line connected between the first repair line and a light emitting device of a pixel circuit, wherein the first repair line is to detect a voltage on the voltage line when the pixel circuit is not in a defective state and the second repair line is not connected to the light emitting device, and wherein the second repair line is connected to the light emitting device and a dummy pixel circuit when the pixel circuit is in a defective state.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
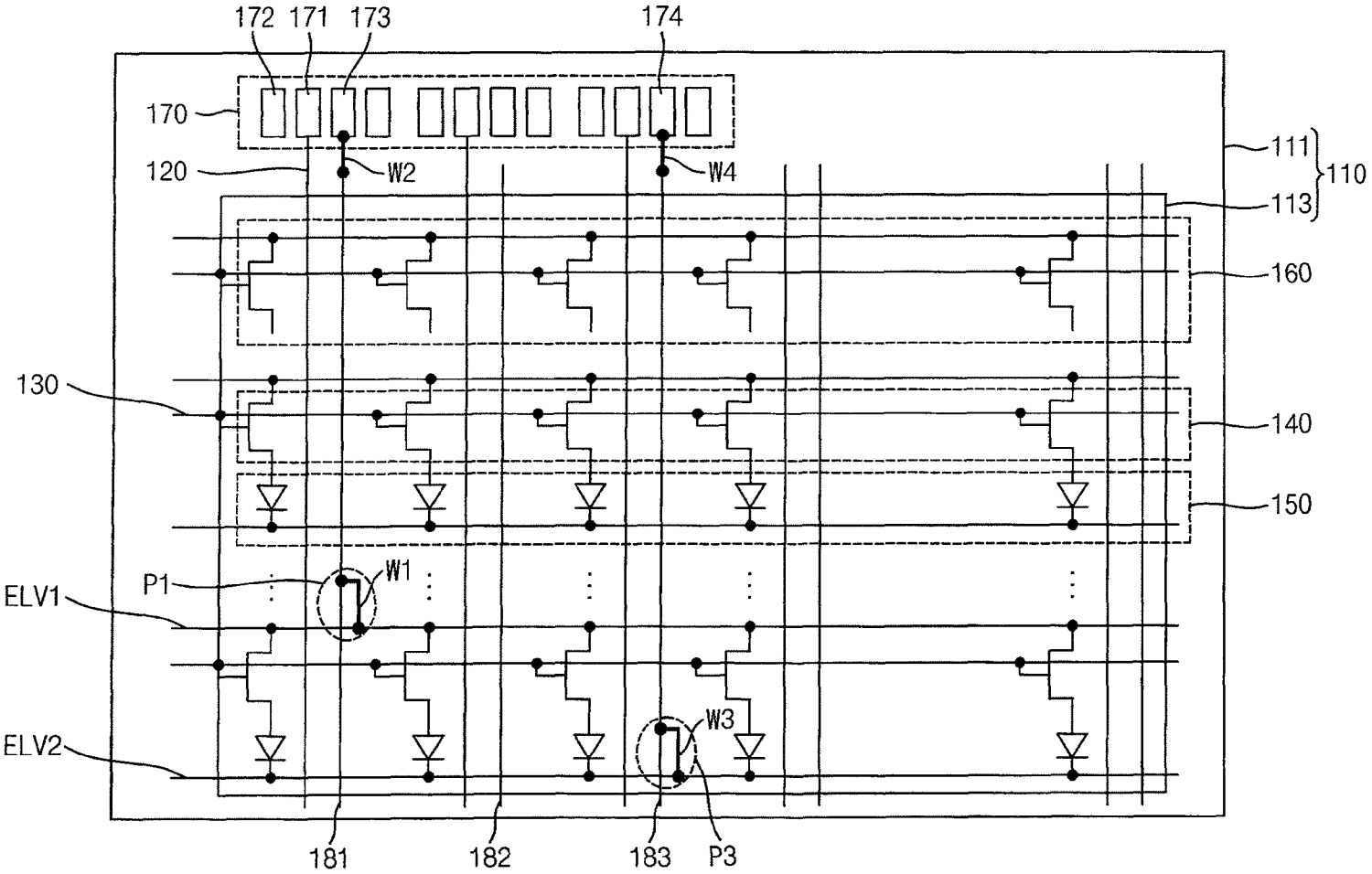
FIG. 1 illustrates an embodiment of a display panel.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

Figure 2:
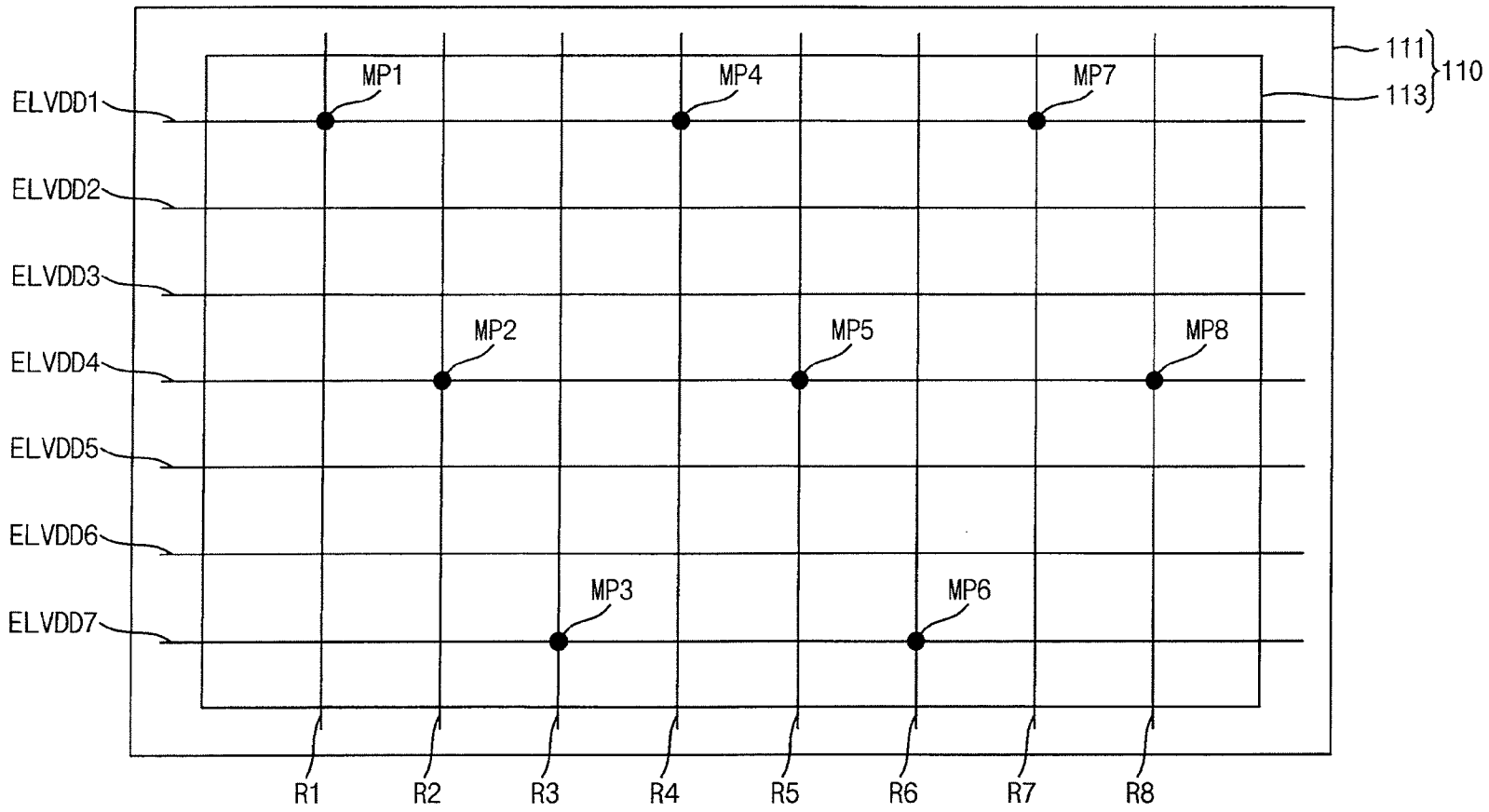
FIG. 2 illustrates an embodiment which includes connections between repair lines and first power supply lines in the display panel.

FIG. 1 illustrates an embodiment of a display panel 100, and FIG. 2 illustrates an example of connections between repair lines and first power supply lines in the display panel of FIG. 1. Referring to FIGS. 1 and 2, the display panel 100 includes a substrate 110, a plurality of data lines 120, a plurality of scan lines 130, a plurality of pixel circuits 140, a plurality of light emitting devices 150, a pad unit 170, a plurality of first voltage lines ELV1, a plurality of second voltage lines ELV2, a plurality of dummy pixel circuits 160, and a repair line group 181, 182 and 183.

The display panel 100 may display an image based on driving signals, including data signals provided through data lines 120 and scan signals provided through scan lines 130. For example, the display panel 100 may be an organic light emitting diode (OLED) display panel, a liquid crystal display panel, a plasma display panel, an electrophoretic display panel, an electro-wetting display panel, etc. For illustrative purposes, the display panel 100 is illustrated as an OLED display panel.

The substrate 110 may support the pixel circuits 140 and the light emitting devices 150. The substrate 110 may include a peripheral region 111 surrounding a display region 113. The pixel circuits 140 and the light emitting devices 150 may be disposed in the display region 113. The pad unit 170 may be disposed in the peripheral region 111.

The data lines 120 may extend from the peripheral region 111 to the display region 113 along a first direction. In one embodiment, the data lines 120 may extend in a vertical direction as illustrated in FIG. 1. The data lines 120 may be spaced apart from each other, and may be parallel with each other. The data lines 120 may be respectively connected to data pads 171 in the pad unit 170, and may be connected to the pixel circuits 140. The data lines 120 may receive the data signals from through the data pads 171, and may transfer the data signals to the pixel circuits 140. For example, a data driving unit may provide the data signals to the pixel circuits 140 through the data pads 171 and the data lines 120.

The scan lines 130 may extend from the peripheral region 111 to the display region 113 along a second direction that is different from the first direction. The scan lines 130 may extend, for example, in a horizontal direction as illustrated in FIG. 1. In this case, the scan lines 130 may intersect the data lines 120. The scan lines 130 may be spaced apart from and parallel with each other. The scan lines 130 may be respectively connected to scan pads the pad unit 170, and may be connected to the pixel circuits 140. The scan lines 130 may receive the scan signals through the scan pads, and may transfer the scan signals to the pixel circuits 140. For example, a scan driving unit may provide the scan signals to the pixel circuits 140 through the scan pads and the scan lines 130.

The pixel circuits 140 may be disposed at the display region 113 of the substrate 110, and may be connected to the data lines 120 and the scan lines 130. For example, the pixel circuits 140 may be arranged in a matrix. For example, the pixel circuits 140 may be respectively located at the intersections of the data lines 120 and the scan lines 130.

Each pixel circuit 140 may include at least one transistor, e.g., a switching transistor and a driving transistor. The pixel circuits 140 may receive the data signals through data lines 120, and may receive the scan signals through the scan lines 130. The pixel circuits 140 may drive the light emitting devices 150 based on the data signals and the scan signals.

The light emitting devices 150 may be respectively connected to the pixel circuits 140. Each light emitting device 150 and a corresponding one of the pixel circuits 140 may form one pixel. The light emitting devices 150 may be organic light emitting diodes. For example, each light emitting device 150 may include at least one selected from an organic light emitting diode emitting red light, an organic light emitting diode emitting green light, an organic light emitting diode emitting blue light, and an organic light emitting diode emitting white light.

In one embodiment, the light emitting devices 150 may emit light based on currents applied to the light emitting devices 150. For example, when a driving voltage is applied between a first electrode and a second electrode of each light emitting device 150, a current may flow through the light emitting device 150. The light emitting device 150 may then emit light based on the current.

The first voltage lines ELV1 may extend from the peripheral region 111 to the display region 113 along a third direction. The first voltage lines ELV1 and the scan lines 130 may extend, for example, in the same direction, e.g., the horizontal direction as in FIG. 1. The first voltage lines ELV1 may be electrically disconnected or insulated from the data lines 120 and the scan lines 130. The first voltage lines ELV1 may be spaced apart from and parallel with each other.

The first voltage lines ELV1 may be electrically connected to the light emitting devices 150. For example, the first voltage lines ELV1 may be electrically connected to the pixel circuits 140, and may be electrically connected to the light emitting devices 150 through the pixel circuits 140. The first voltage lines ELV1 may provide a first voltage (e.g., a high power supply voltage (ELVDD)) to the light emitting devices 150, and the light emitting devices 150 may emit light based on the first voltage.

The second voltage lines ELV2 may be further disposed on the substrate 110. In one embodiment, the second voltage lines ELV2 may extend from the peripheral region 111 to the display region 113 along a fourth direction. For example, the second voltage lines ELV2 and the scan lines 130 may extend in the same direction, e.g., the horizontal direction as in FIG. 1. The second voltage lines ELV2 may be electrically disconnected or insulated from the data lines 120 and the scan lines 130. The second voltage lines ELV2 may be spaced apart and parallel with each other.

In one embodiment, the second voltage lines ELV2 may be implemented as one common electrode plane covering the display region 113. The second voltage lines ELV2 may be connected to the light emitting devices 150. For example, the second voltage lines ELV2 may be connected to second electrodes of the light emitting devices 150. The second voltage lines ELV2 may provide a second voltage (e.g., a low power supply voltage (ELVSS)) to the light emitting devices 150. The light emitting devices 150 may emit light based on the first voltage and the second voltage.

The dummy pixel circuits 160 may be disposed on the substrate 110. The dummy pixel circuits 160 may include all or some of the same devices or transistors as the pixel circuits 140. For example, each dummy pixel circuit 160 may include at least one transistor. e.g., a switching transistor and a driving transistor. The dummy pixel circuits 160 may be substituted for defective ones of the pixel circuits 140.

The pad unit 170 may include a plurality of data pads 171 connected to the data lines 120 at the peripheral region 111, and a plurality of dummy pads 172, 173 and 174. The data pads 171 may be respectively connected to the data lines 120. The data signals from the data driving unit may be applied to the data lines 120 through the data pads 171. The dummy pads 172, 173, and 174 may be adjacent to the data pads 171, and may not be connected to the data lines 120. The dummy pads 172, 173 and 174 may include a first dummy pad 173 connected to a first repair line 181, a second dummy pad 174 connected to a third repair line 183, and a third dummy pad 172 that is not connected to the repair line group 181, 182 and 183.

The repair line group 181, 182, and 183 may include a plurality of lines extending in a predetermined direction. For example, the plurality of lines in the repair line group 181, 182 and 183 may extend in the direction in which the data lines 120 extend. The repair line group 181, 182 and 183 may have the same number of lines as the data lines 120.

The repair line group 181, 182 and 183 may be electrically disconnected or insulated from the data lines 120 and the scan lines 130. For example, a first insulating layer may be between the repair line group 181, 182 and 183 and the data lines 120, to insulate the repair line group 181, 182 and 183 from the data lines 120. A second insulating may be between the repair line group 181, 182 and 183 and the scan lines 130, to insulate the repair line group 181, 182 and 183 from the scan lines 130.

In accordance with one embodiment, the repair line group 181, 182, and 183 is not only used to repair the defective pixel circuits, but also to measure voltages levels of voltages (e.g., the first voltage (e.g., ELVDD) and/or the second voltage (e.g., ELVSS)) at predetermined positions to obtain an amount of a voltage drop and/or to detect whether a crack or damage exists. The repair line group 181, 182 and 183 may include a first repair line 181, a second repair line 182, and a third repair line 183.

The first repair line 181 may be connected to a corresponding one of the first voltage lines ELV1, and may be connected to a first one 173 of the dummy pads 172, 173 and 174. For example, an end of the first repair line 181 may be connected to the first one 173 of the dummy pads 172, 173 and 174 at the peripheral region 111. Another end of the first repair line 181 may be connected to a corresponding one of the first voltage lines ELV1 at a first position P1 in the display region 113.

In one embodiment, the first repair line 181 may be connected to the corresponding one of the first voltage lines ELV1 and the first one 173 of the dummy pads 172, 173 and 174 by laser welding. For example, if a laser is incident on a first welding portion W1, the first repair line 181 may be welded to the corresponding one of the first voltage lines ELV1.

Further, if a laser is incident on a second welding portion W2, the first repair line 181 may be welded to the first one 173 of the dummy pads 172, 173 and 174. In this case, the first voltage at the first position P1 may be applied to the first one 173 of the dummy pads 172, 173 and 174 through the first repair line 181. A voltage level of a voltage of the first one 173 of the dummy pads 172, 173 and 174 may be substantially the same as a voltage level of the first voltage at the first position P1. Thus, the first repair line 181 may serve as a detection line for measuring the voltage level of the first voltage at the first position P1.

The voltage level of the first voltage at the first position P1 measured using the first repair line 181 may be used to calculate an amount of a voltage drop (e.g., IR drop) of the first voltage at the first position P1. The first voltage lines ELV1 and the second voltage lines ELV2 are connected to a number of the pixel circuits 140 and a number of the light emitting devices 150. As the size of the display panel 100 increases, the number of the pixel circuits 140 and the number of the light emitting devices 150 may increase.

Accordingly, a large amount of the voltage drop, particularly at a center region of the display panel 100, may occur due to a loading effect. Thus, current flowing through the light emitting devices 150 at the center region may be reduced due to the voltage drop, and luminance of the light emitting devices 150 at the center region may be decreased. This may produce non-uniformity of luminance or color of the display panel 100.

To compensate the voltage drop, a display device may include a voltage drop compensating circuit that estimates an amount of the voltage drop by analyzing image data, and adjusts voltage levels of the data signals based on the estimated voltage drop. The voltage drop compensating circuit may not be able to determine the exact amount of the voltage drop in all instances. Thus, it takes much time to estimate the amount of the voltage drop by performing a complicated algorithm.

However, the display panel 100 according to the present embodiment accurately detects the voltage level of the first voltage at the first position P1 without performing the complicated algorithm. This is accomplished by using the first repair line 181. As a result, the amount of the voltage drop is accurately and rapidly obtained.

In another embodiment, the first repair line 181 may be used to monitor whether the display panel 100 is damaged. For example, the display panel 100 may be damaged, for example, by physical impact. In this case, a pixel circuit at a damaged portion may be shorted and/or an overcurrent may flow at the damaged portion. As a result, the display panel 100 may be burned.

A display device may include an overcurrent preventing circuit for preventing burning due to the overcurrent. The overcurrent preventing circuit checks whether leakage current flows in a display panel during a non-emission period (e.g., a blank period or a blank frame) when light emitting devices do not emit light. If leakage current is detected, the overcurrent preventing circuit cuts off the supply of power supply voltages. However, in a case where a display panel is driven with a digital driving method, a blank period or blank frame does not exists. Thus, the overcurrent preventing circuit cannot detect whether the display panel is damaged.

In accordance with at least one embodiment, the display panel 100 accurately and rapidly determines whether the display panel 100 is damaged by detecting the voltage level of the first voltage at the first position P1 using the first repair line 181. For example, when a crack occurs at the first position P1, the voltage level of the first voltage at the first position P1 may be drastically decreased. Because the change in voltage level of the first voltage at the first position P1 is readily detected using the first repair line 181, the crack at the first position P1 is detected in real time. Further, the display panel 100 according to at least one embodiment may be driven with not only an analog driving method but also a digital driving method.

In one embodiment, the repair line group 181, 182, and 183 may include a plurality of first repair lines 181. Although FIG. 1 illustrates an example of the repair line group 181, 182, and 183 including one first repair line 181, in FIG. 2, a plurality of first repair lines R1, R2, R3, R4, R5, R6, R7 and R8 connected to the first voltages lines ELVDD1, ELVDD2, ELVDD3, ELVDD4, ELVDD5, ELVDD6, and ELVDD7 at a plurality of positions MP1, MP2, MP3, MP4, MP5, MP6, MP7, and MP8.

For example, the repair line group may include first repair lines R1, R4, and R7 connected to a first voltage line ELVDD1 at a first row at first, fourth, and seventh positions MP1, MP4, and MP7. First repair lines R2, R5, and R8 are connected to a first voltage line ELVDD4 at a fourth row at second, fifth, and eighth positions MP2, MP5, and MP8. First repair lines R3 and R6 are connected to a first voltage line ELVDD7 at a seventh row at third and sixth positions MP3 and MP6. In this case, voltage levels of the first voltage at the positions MP1, MP2, MP3, MP4, MP5, MP6, MP7, and MP8 may be measured through the first repair lines R1, R2, R3, R4, R5, R6, R7, and R8. The measured voltage levels may be used to calculate the amounts of voltage drop at the positions MP1, MP2, MP3, MP4, MP5, MP6, MP7, and MP8, or may detect whether a crack or damage exists at positions MP1, MP2, MP3, MP4, MP5, MP6, MP7, and MP8. The plurality of positions MP1, MP2, MP3, MP4, MP5, MP6, MP7 and MP8 may be uniformly distributed throughout the display region 113 of the substrate 110. In another embodiment, a different number or locations of the positions MP1, MP2, MP3, MP4, MP5, MP6, MP7, and MP8 may be used, and/or a different numbers of first repair lines R1, R2, R3, R4, R5, R6, R7, and R8.

As illustrated in FIG. 1, the second repair line 182 may be spaced apart from the first repair line 181, and may be not connected to the dummy pads 172, 173, and 174 and the first voltage lines ELV1. The second repair line 182 may be used to repair the defective pixel circuits. For example, if at least one of the pixel circuits 140 is damaged during a manufacturing process, a corresponding one of the light emitting devices 150 connected to the defective pixel circuit may not emit light. In this case, the second repair line 182 may be used to connect the corresponding one of the light emitting devices 150 to one of the dummy pixel circuits 160. The one of the dummy pixel circuits 160 may then be used to drive the corresponding one of the light emitting devices 150 to emit light.

The third repair line 183 may be spaced apart from the first repair line 181 and the second repair line 182, may be connected to one of the second voltage lines ELV2, and may be connected to a second one 174 of the dummy pads 172, 173, and 174. For example, an end of the third repair line 183 may be connected to the second one 174 of the dummy pads at the peripheral region 111. Another end of the third repair line 183 may be connected to the corresponding one of the second voltage lines ELV2 at a third position P4 in the display region 113.

In one embodiment, the third repair line 183 may be connected to a corresponding one of the second voltage lines ELV2 and the second one 174 of the dummy pads 172, 173, and 174, for example, by laser welding. For example, if a laser is incident on a third welding portion W3, the third repair line 183 may be welded to the corresponding one of the second voltage lines ELV2. Further, if a laser is incident on a fourth welding portion W4, the third repair line 183 may be welded to the second one 174 of the dummy pads 172, 173, and 174. In this case, the second voltage at the third position P3 may be applied to the second one 174 of the dummy pads 172, 173, and 174 through the third repair line 183. A voltage level of a voltage of the second one 174 of the dummy pads 172, 173, and 174 may be substantially the same as a voltage level of the second voltage at the third position P3. Thus, the third repair line 183 may serve as a detection line for measuring the voltage level of the second voltage at the third position P3.

In one embodiment, the voltage level of the second voltage at the third position P3, measured using the third repair line 183, may be used to calculate an amount of a voltage drop (e.g., IR drop) of the second voltage at the third position P3. Thus, in accordance with at least one embodiment, the display panel 100 may accurately detect the voltage level of the second voltage at the third position P3 using the third repair line 183. The amount of the voltage drop may therefore be accurately and rapidly obtained.

In one embodiment, the third repair line 183 may be used to monitor whether the display panel 100 is damaged. For example, the voltage level of the first voltage at the first position P1 may be measured using the first repair line 181. The voltage level of the second voltage at the third position P3 adjacent to the first position P1 may be further measured using the third repair line 183. In this case, when a crack or damage occurs near the first position P1 and the third position P3, a difference value between the voltage level of the first voltage at the first position P1 and the voltage level of the second voltage at the third position P3 may be drastically decreased.

Thus, in accordance with one embodiment, to detect the crack or damage, the display panel 100 measures a difference value between the voltage level of the first voltage at the first position P1 and the voltage level of the second voltage at the third position P3 using the first repair line 181 and the third repair line 183.

Figure 3A:
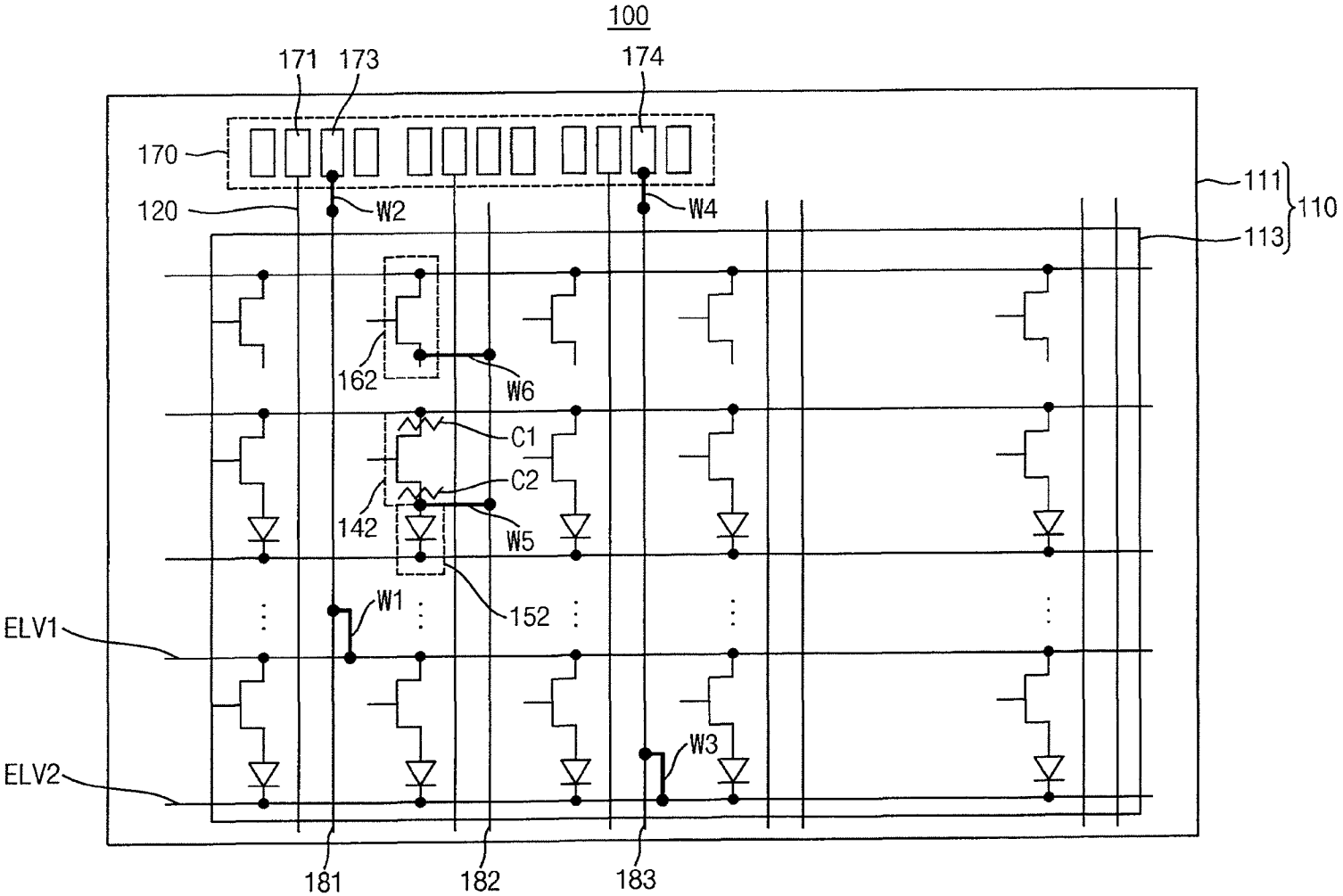
FIGS. 3A-3C illustrate embodiments of a method for repairing defective pixels.
Figure 3B:
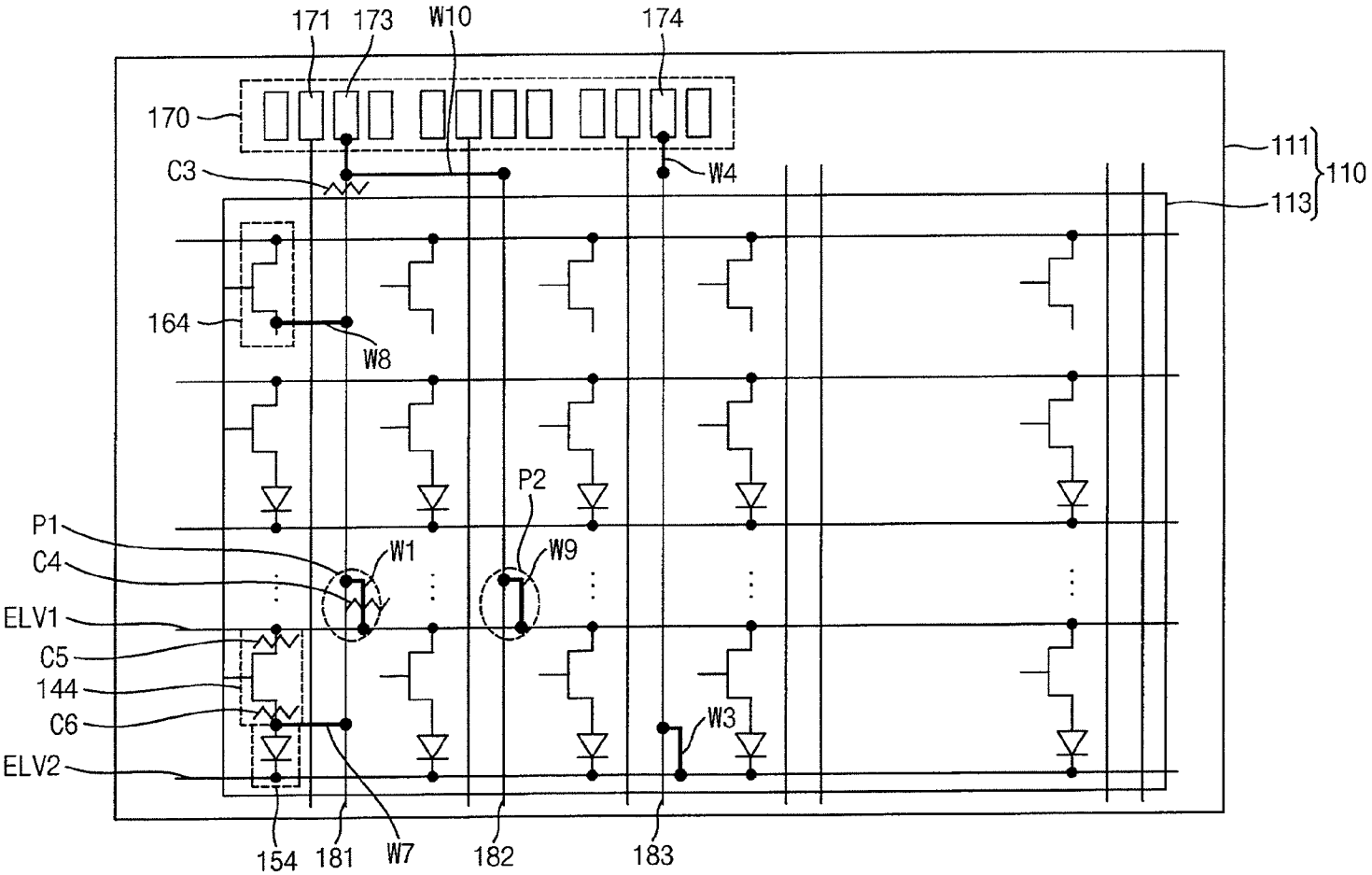
Figure 3C:
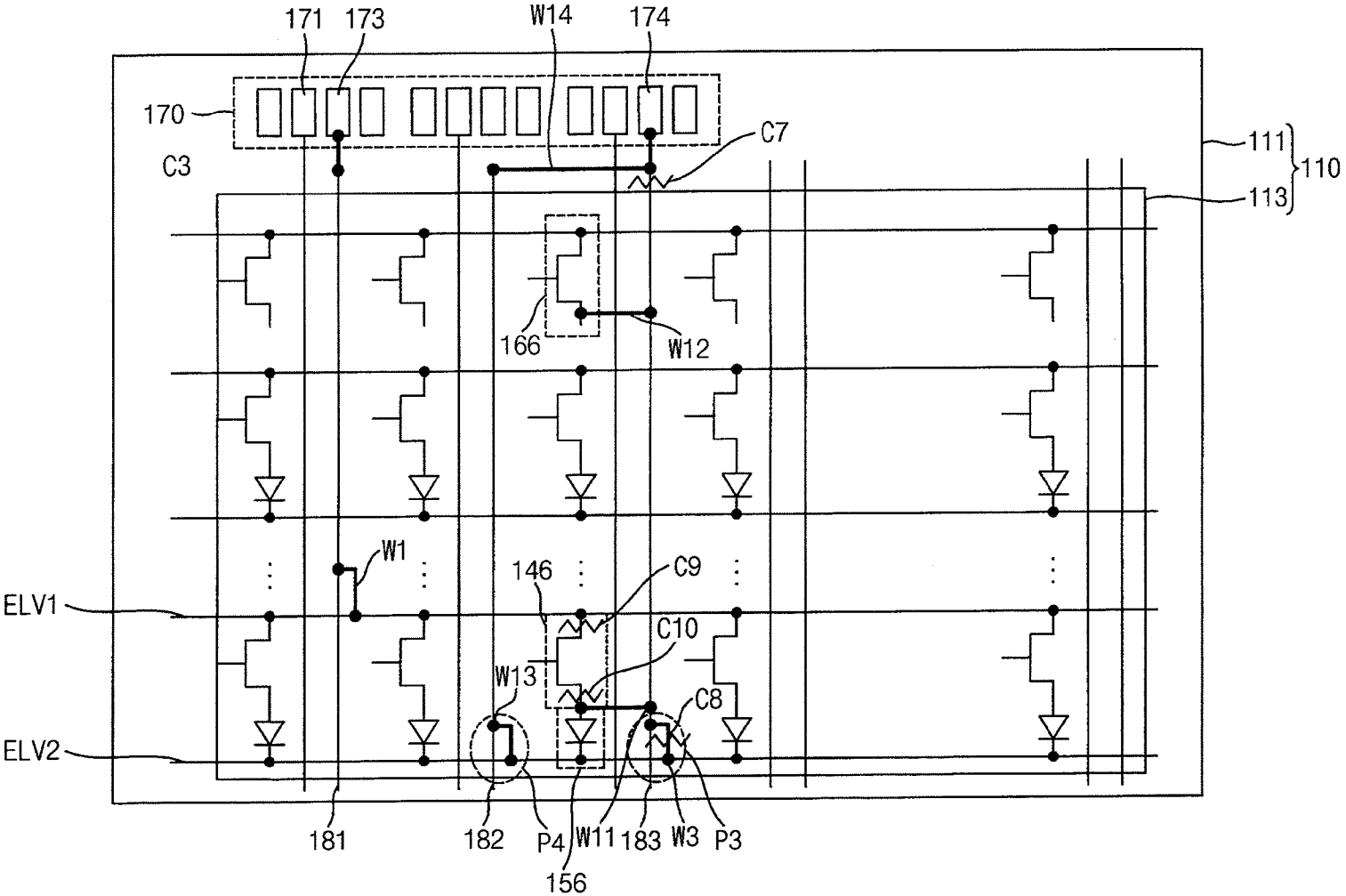

FIGS. 3A-3C illustrate an embodiment of a method for repairing defective pixels in a display panel, which, for example, may be the display panel in FIG. 1. Referring to FIGS. 3A-3C, each defective pixel circuit 142, 144, and 146 may be repaired by at least one of the first repair line 181, the second repair line 182, or the third repair line 183. For example, each defective pixel circuit 142, 144, and 146 may be repaired by a most closely adjacent one of the first, second, or third repair lines 181, 182, and 183.

As illustrated in FIG. 3A, a defective pixel circuit 142 may be repaired by the adjacent second repair line 182. In one embodiment, as described above, the first repair line 181 may be used to detect the voltage level of the first voltage (e.g., a high power supply voltage (ELVDD)) at the first position P1. The third repair line 183 may be used to detect the voltage level of the second voltage (e.g., a low power supply voltage (ELVSS)) at the third position P3. The second repair line 182 may not be used to detect a voltage level. The second repair line 182 may be used to connect the dummy pixel circuit 162 to the light emitting device 152.

The defective pixel circuit 142 may be disconnected from the light emitting device 152, e.g., by laser cutting. By irradiating a laser onto at least one cutting portion C1 and C2, the defective pixel circuit 142 may be disconnected from the light emitting device 152.

Further, the second repair line 182 adjacent to the light emitting device 152 may be connected to the light emitting device 152, e.g., by laser welding. For example, if a laser is incident on a fifth welding portion W5, the second repair line 182 may be welded to the light emitting device 152. The second repair line 182 may be further connected to the dummy pixel circuit 162. Among the plurality of dummy pixel circuits, the adjacent dummy pixel circuit 162 may be selected to be connected to the second repair line 182.

For example, if a laser is incident on a sixth welding portion W6, the second repair line 182 may be welded to the dummy pixel circuit 162. Thus, the light emitting device 152 may be connected to the dummy pixel circuit 162, and the dummy pixel circuit 162 may be substituted for the defective pixel circuit 142. Accordingly, the light emitting device 152 may operate normally. In this case, the first repair line 181 may be used to detect the voltage level of the first voltage, the second repair line 182 may be used to repair the defective pixel circuit 142, and the third repair line 183 may be used to detect the voltage level of the second voltage.

As illustrated in FIG. 3B, a defective pixel circuit 144 may be repaired by the first repair line 181. For example, the first repair line 181 may be the most closely adjacent one of the repair lines 181, 182 and 183. In this case, the first repair line 181 may be used to repair the defective pixel circuit 144, and one of the second repair lines 182 may be used to detect the voltage level of the first voltage.

In one embodiment, the defective pixel circuit 144 may be disconnected from the light emitting device 154 by laser cutting. By irradiating a laser to at least one cutting portion C5 and C6, the defective pixel circuit 144 may be disconnected from the light emitting device 154. Further, the first repair line 181 may be disconnected from the corresponding one of the first voltage lines ELV1 and the first one 173 of the dummy pads. By irradiating a laser to at least one cutting portion C3 and C4, the first welding portion W1 and/or the second welding portion W2 may be cut.

The first repair line 181 may be connected to the light emitting device 154 and the dummy pixel circuit 164 by laser welding. For example, by irradiating a laser to a seventh welding portion W7 and an eighth welding portion W8, the first repair line 181 may be welded to the light emitting device 154 and the dummy pixel circuit 164. The second repair lines 182 adjacent to the first repair line 181 may be connected to a corresponding one of the first voltage lines ELV1 at a second position P2 adjacent to the first position P1 by laser welding. This second repair line 182 may be further connected to the first one 173 of the dummy pads by laser welding. For example, by irradiating a laser to a ninth welding portion W9 and a tenth welding portion W10, the one of the second repair lines 182 may be welded to the corresponding one of the first voltage lines ELV1 and the first one 173 of the dummy pads.

Although the second repair line 182 is connected to the corresponding one of the first voltage lines ELV1 at the second position P2, the first voltage at the second position P2 may have a similar (or substantially the same) voltage level to the first voltage at the first position P1, because the second position P2 is adjacent to the first position P1. In this case, the first repair line 181 may be used to repair the defective pixel circuit 144, the second repair line 182 may be used to detect the voltage level of the first voltage, and the third repair line 183 may be used to detect the voltage level of the second voltage.

As illustrated in FIG. 3C, a defective pixel circuit 146 may be repaired by the third repair line 183. For example, the third repair line 183 may be the most closely adjacent one of the repair lines 181, 182, and 183. In this case, the third repair line 183 may be used to repair the defective pixel circuit 146, and one of the second repair lines 182 may be used to detect the voltage level of the second voltage.

In one embodiment, the defective pixel circuit 146 may be disconnected from the light emitting device 156 by laser cutting. By irradiating a laser to at least one cutting portion C9 and C10, the defective pixel circuit 146 may be disconnected from the light emitting device 156.

The third repair line 183 may be disconnected from the corresponding one of the second voltage lines ELV2 and the second one 174 of the dummy pads. By irradiating a laser to at least one cutting portion C7 and C8, the third welding portion W3 and/or the fifth welding portion W4 may be cut.

The third repair line 183 may be connected to the light emitting device 156 and the dummy pixel circuit 166 by laser welding. For example, by irradiating a laser to an eleventh welding portion W11 and a twelfth welding portion W12, the third repair line 183 may be welded to the light emitting device 156 and the dummy pixel circuit 166.

The second repair lines 182 adjacent to the third repair line 183 may be connected to the corresponding one of the second voltage lines ELV2 at a fourth position P4 adjacent to the third position P3 by laser welding, and may be further connected to the second one 174 of the dummy pads by laser welding. For example, by irradiating a laser to a thirteenth welding portion W13 and a fourteenth welding portion W14, the one of the second repair lines 182 may be welded to the corresponding one of the second voltage lines ELV2 and the second one 174 of the dummy pads.

Although the second repair lines 182 is connected to the corresponding one of the second voltage lines ELV2 at the fourth position P4, the second voltage at the fourth position P4 may have a similar (or substantially the same) voltage level to the second voltage at the third position P3, because the fourth position P4 is adjacent to the third position P3. In this case, the first repair line 181 may be used to detect the voltage level of the first voltage, the second repair line 182 may be used to detect the voltage level of the second voltage, and the third repair line 183 may be used to repair the defective pixel circuit 146.

As described above, the repair lines 181, 182, and 183 may be used to repair the defective pixel circuits 142, 144, and 146. Also, at least a portion of the repair lines 181, 182, and 183 of the display panel 100 may be used to detect the voltage levels of the first and/or second voltages at least one position P1, P2, P3, and P4.

In one embodiment, the detected voltage levels may be used to obtain voltage drops at the position P1, P2, P3, and P4. Thus, the voltage drops may be accurately compensated. In another embodiments, the detected voltage levels may be used to detect an overcurrent (or a crack) at the position P1, P2, P3, and P4. Thus, the damage of the display panel 100 may be rapidly detected.

In the display panel 100 according to at least one embodiment, the defective pixel circuits 142, 144, and 146 may be efficiently repaired by the repair lines 181, 182, and 183. Thus, the production yield for the display panel 100 may be improved. Further, because the portion of the repair lines 181, 182, and 183 may be used as detection lines, an additional process for forming the detection lines is not required.

Figure 4:
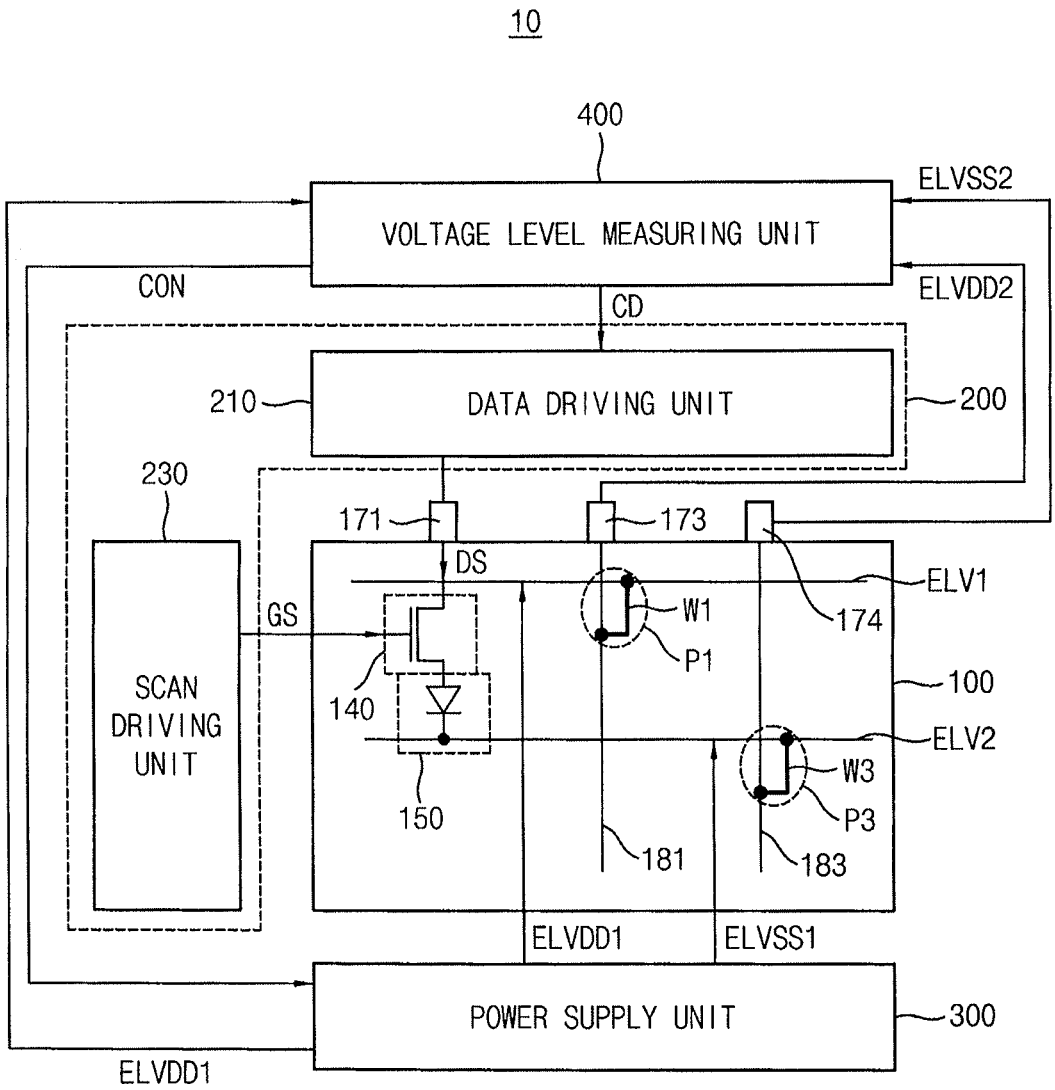
FIG. 4 illustrates an embodiment of a display device.
Figure 5:
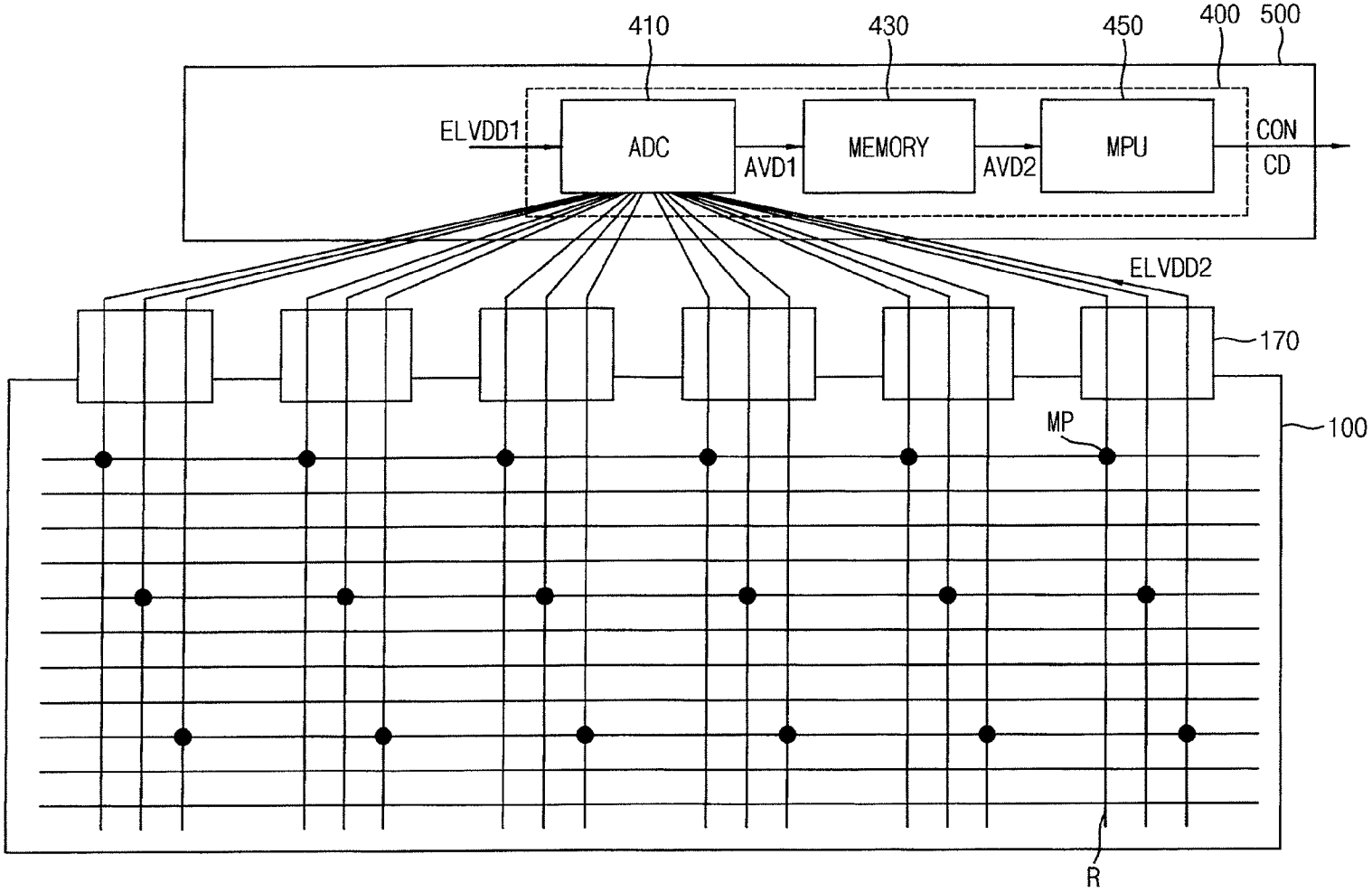
FIG. 5 illustrates an embodiment of a voltage level measuring unit.

FIG. 4 illustrates an embodiment of a display device, and FIG. 5 illustrating an embodiment of a voltage level measuring unit in the display device of FIG. 4. Referring to FIGS. 4 and 5, a display device 10 includes display panel 100, a panel driving unit 200, a power supply unit 300, and a voltage level measuring unit 400. The display panel 100 may be, for example, an organic light emitting diode (OLED) display device, a liquid crystal display device, a plasma display panel display device, an electrophoretic display device, an electro-wetting display device, etc.

The display panel 100 may display an image based on driving signals DS and GS and first and second voltages ELVDD1 and ELVSS1 (e.g., high and low power supply voltages). The display panel 100 may be substantially the same as or similar to the display panel 100 in FIGS. 1 and 2.

The panel driving unit 200 may be connected to a pad unit of the display panel 100, and may provide the driving signals DS and GS to the display panel 100. The panel driving unit 200 may include a data driving unit 210 and a scan driving unit 230. The data driving unit 210 may generate data signals DS based on image data, and may apply the data signals DS to data pads 171 of the display panel 100. The scan driving unit 230 may generate scan signal GS and may provide the scan signals to scan pads. The data signals DS applied to the data pads 171 may be provided to pixel circuits 140 through data lines. The scan signals GS applied to the scan pads may be provided to the pixel circuits 140 through scan lines. The scan driving unit 230 may be formed on the display panel 100, and the scan driving unit 230 may apply the scan signals GS to the scan lines.

The power supply unit 300 may supply the display panel 100 with the first voltage ELVDD1 (e.g., the high power supply voltage) and the second voltage ELVSS1 (e.g., the low power supply voltage). The power supply unit 300 may be connected to first voltage lines ELV1 and second voltage lines ELV2. The power supply unit 300 may also provide the first voltage ELVDD1 and the second voltage ELVSS1 to the voltage level measuring unit 400.

The voltage level measuring unit 400 may measure a first voltage level of the first voltage ELVDD1 provided (e.g., directly) from the power supply unit 300, and may measure a second voltage level of the first voltage ELVDD2 at a predetermined position P1 through a first one 173 of dummy pads 173 and 174. The voltage level measuring unit 400 may be connected to the dummy pads 173 and 174 of the pad unit of the display panel 100 and the power supply unit 300. A first repair line 181 of the display panel 100 may be connected to a corresponding one of the first voltage lines ELV1 at a first position P1, and may be connected to the first one 173 of dummy pads 173 and 174. Thus, the second voltage level of the first voltage ELVDD2 at the first position P1 may be measured through the first repair line 181 and the first one 173 of dummy pads 173 or 174.

As described above, the second voltage level of the first voltage ELVDD2 at the first position P1 may be reduced compared with the first voltage level of the first voltage ELVDD1 at the power supply unit 300 by the loading effect. Further, in a case where a crack occurs at the display panel 100, an overcurrent may flow at the display panel 100, and the voltage level of the first voltage ELVDD2 at the first position P1 may be drastically reduced compared with the first voltage level of the first voltage ELVDD1 at the power supply unit 300.

In one embodiment, the voltage level measuring unit 400 may receive the second voltage ELVSS1 (e.g., directly) from the power supply unit 300, and may measure a third voltage level of the second voltage ELVSS2 at a predetermined position P3 through a second one 174 of dummy pads 173 or 174. A third repair line 183 of the display panel 100 may be connected to a corresponding one of the second voltage lines ELV2 at a third position P3, and may be further connected to the second one 174 of dummy pads 173 and 174. Thus, the third voltage level of the second voltage ELVSS2 at the third position P3 may be measured through the third repair line 183 and the second one 174 of dummy pads 173 or 174.

Because the voltage level measuring unit 400 measures not only the second voltage level of the first voltage ELVDD2 but also the third voltage level of the second voltage ELVSS2, the voltage drop at the predetermined position P1 and P3 may be accurately measured, and/or the damage at the predetermined position P1 and P3 may be accurately detected.

As illustrated in FIG. 5, an embodiment of the voltage level measuring unit 400 may include an analog-to-digital converter 410, a memory 430, and a microprocessor 450. The analog-to-digital converter 410 may convert each voltage level of the first voltage ELVDD1 from the power supply unit 300, the first voltage ELVDD2 from the first one 173 of the dummy pads 173 and 174, the second voltage ELVSS1 from the power supply unit 300 and the second voltage ELVSS2 from the second one 174 of the dummy pads 173 and 174 into digital data AVD1. The analog-to-digital converter 410 may be connected to the power supply unit 300 and the pad unit 170 of the display panel 100. The analog-to-digital converter 410 may store the digital data AVD1 in the memory 430.

The memory 430 may store the digital data AVD1. For example, the memory 430 may include a volatile memory such as a dynamic random access memory (DRAM), a static random access memory (SRAM), a mobile DRAM, a double data rate (DDR) synchronous DRAM (SDRAM), a low power DDR (LPDDR) SDRAM, and/or a nonvolatile memory, such as an electrically erasable programmable read-only memory (EEPROM), a flash memory, a phase change random access memory (PRAM), a resistance random access memory (RRAM), a nano floating gate memory (NFGM), a polymer random access memory (PoRAM), a magnetic random access memory (MRAM), or a ferroelectric random access memory (FRAM), etc.

The microprocessor 450 may read the digital data AVD2 from the memory 430, and may perform predetermined operations on the digital data AVD2. The microprocessor 450 may generate comparison data CD and/or a cut-off signal CON based on the digital data AVD2.

As described above, the voltage drop may occur due to the loading effect. Also, the luminance of the light emitting devices 150 may be deteriorated. To compensate for the deterioration of luminance of the light emitting devices 150, the voltage level measuring unit 400 may measure the first voltage level of the first voltage ELVDD1 from the power supply unit 300 and the second voltage level of the first voltage ELVDD2 from the first one 173 of the dummy pads 173 or 174.

For example, the second voltage level of the first voltage ELVDD2 at the first position P1 may be measured by the voltage level measuring unit 400 through the first repair line 181 and the first one 173 of the dummy pads 173 or 174. For example, the analog-to-digital converter 410 may convert the first voltage level of the first voltage ELVDD1 from the power supply unit 300 and the second voltage level of the first voltage ELVDD2 from the first one 173 of the dummy pads 173 or 174 to first digital data and second digital data as the digital data AVD1. The first digital data and the second digital data may be stored in the memory 430.

The microprocessor 450 may read the first digital data and the second digital data as the digital data AVD2 from the memory 430, and then generate comparison data CD. The comparison data CD may be generated by comparing the first digital data corresponding to the first voltage level and the second digital data corresponding to the second voltage level. The data driving unit 210 may adjust voltage levels of the data signals DS based on the comparison data CD to compensate the voltage drop.

Accordingly, the luminance of the light emitting devices 150 may be uniform at the same gray level throughout the display panel 100. In one embodiment, the analog-to-digital converter 410 may generate the first and second digital data with a predetermined period. For example, the analog-to-digital converter 410 may generate the first and second digital data a predetermined number N times per frame. The microprocessor 450 may calculate an average value of the N first digital data and an average value of the N second digital data, and may generate the comparison data CD based on the average values.

When a crack occurs at the display panel 100 (e.g., by a physical impact), an overcurrent may flow and the display panel 100 may be burned. To prevent burning due to the overcurrent, the microprocessor 450 may calculate a difference value between the first digital data corresponding to the first voltage level and the second digital data corresponding to the second voltage level. The microprocessor 450 may then generate the cut-off signal CON when the difference value is greater than a predetermined value.

For example, when the crack occurs at the display panel 100, the second voltage level of the first voltage ELVDD2 at the first position P1 may be drastically decreased compared with the first voltage level of the first voltage ELVDD1 at the power supply unit 300. The microprocessor 450 may calculate the difference value with a predetermined period, and may generate the cut-off signal CON when the difference value is greater than the predetermined value. The power supply unit 300 may stop supplying the first voltage ELVDD1 and the second voltage ELVSS1 in response to the cut-off signal CON. Accordingly, an overcurrent may not flow and burning due to overcurrent may be prevented.

In another embodiment, the microprocessor 450 may calculate a difference value between first digital data corresponding to the second voltage level of the first voltage ELVDD2 at the first position P1 and second digital data corresponding to the third voltage level of the second voltage ELVSS2 at the third position P3. The microprocessor 450 may generate the cut-off signal CON when the difference value is smaller than a predetermined value. For example, when a crack occurs at the display panel 100, a voltage difference between the first voltage ELVDD2 at the first position P1 and the second voltage ELVSS2 at the third position adjacent to the first position P1 may be drastically decreased. The microprocessor 450 may obtain the difference value corresponding to the voltage difference between the first voltage ELVDD2 and the second voltage ELVSS2, and may generate the cut-off signal CON when the difference value is smaller than the predetermined value. The power supply unit 300 may stop supplying the first voltage ELVDD1 and the second voltage ELVSS1 in response to the cut-off signal CON.

The voltage level measuring unit 400 may be coupled to or disposed on a source board 500. For example, the voltage level measuring unit 400 may be mounted on the source board 500 in the form of a microcontroller unit (MCU). In another example, the voltage level measuring unit 400 may be implemented in a timing controller.

The voltage level measuring unit 400 of the display device 10 may measure the voltage level of the first voltage and/or the second voltage using the repair line 181 and 183. Based on the measured voltage level, the voltage drop of the display device 10 may be compensated, and/or the overcurrent may be rapidly detected to prevent the burning of the display device 10.

By way of summation and review, a display panel has been developed to include dummy pixel circuits and repair lines. When a defective pixel circuit is found during a manufacturing process, the defective pixel circuit is substituted with the dummy pixel circuit. For example, an OLED connected to the defective pixel circuit may be disconnected from the defective pixel circuit. Then, the OLED may be connected to the adjacent repair line, and the repair line may be connected to the dummy pixel circuit. However, the repair line is not used when the pixel circuit is not defective.

In accordance with one or more of the aforementioned embodiments, a display panel includes repair lines which are not only used to repair defective pixel circuits, but also are used to measure voltages levels of ELVDD (and/or ELVSS) to measure a voltage drop of the ELVDD, and/or to detect an overcurrent caused by a crack or damage. That is, at least one repair line that is not used because corresponding pixel circuits are not defective may be used as a detection line for measuring the voltage level.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display panel, comprising:

a substrate including a peripheral region adjacent a display region;

a plurality of data lines extending from the peripheral region to the display region in a first direction;

a plurality of scan lines extending from the peripheral region to the display region in a second direction;

a pad area including a plurality of data pads and a plurality of dummy pads, the data pads connected to the data lines at the peripheral region;

a plurality of pixel circuits in the display region and connected to the data lines and the scan lines;

a plurality of light emitting devices respectively connected to the pixel circuits and to emit light by currents flowing therein;

a plurality of first voltage lines extending from the peripheral region to the display region in a third direction and to supply the currents to the light emitting devices therethrough, the first voltage lines connected to the pixel circuits to provide a first power supply voltage to the light emitting devices; and a repair line group including at least one first repair line and a plurality of second repair lines, wherein the at least one first repair line has an end connected to a first one of the dummy pads in the peripheral region and another end directly connected to a corresponding one of the first voltage lines at a first position in the display region when a corresponding one of the pixel circuits is not defective, and wherein the second repair lines are not connected to the dummy pads and the first voltage lines.

2. The display panel as claimed in claim 1, further comprising:

a plurality of dummy pixel circuits spaced apart from the pixel circuits, wherein the dummy pixel circuits are adjacent to the at least one first repair line and the second repair lines.

3. The display panel as claimed in claim 2, wherein, when a defective pixel circuit is disconnected from a corresponding one of the light emitting devices:

one of the second repair lines adjacent to the defective pixel circuit is connected to the corresponding one of the light emitting devices, and is connected to one of the dummy pixel circuits adjacent to the one of the second repair lines.

4. The display panel as claimed in claim 2, wherein, when a defective pixel circuit is disconnected from a corresponding one of the light emitting devices:

the at least one first repair line is disconnected from the first one of the dummy pads and the corresponding one of the first voltage lines, is connected to the corresponding one of the light emitting devices, and is connected to one of the dummy pixel circuits adjacent to the at least one first repair line, and one of the second repair lines adjacent to at least one first repair line is connected to the corresponding one of the first voltage lines at a second position in the display region, and is connected to the first one of the dummy pads.

5. The display panel as claimed in claim 2, further comprising:

a plurality of second voltage lines extending from the peripheral region to the display region in a fourth direction, the second voltage lines connected to the light emitting devices to provide a second power supply voltage to the light emitting devices, wherein the repair line group includes at least one third repair line having an end connected to a second one of the dummy pads at the peripheral region and another end connected to a corresponding one of the second voltage lines at a third position in the display region.

6. The display panel as claimed in claim 5, wherein, when one of the pixel circuits adjacent to the at least one third repair line is defective and the defective pixel circuit is disconnected from a corresponding one of the light emitting devices:

the at least one third repair line is disconnected from the second one of the dummy pads and the corresponding one of the second voltage lines, is connected to the corresponding one of the light emitting devices, and is connected to one of the dummy pixel circuits adjacent to the at least one third repair line, and one of the second repair lines adjacent to at least one third repair line is connected to the corresponding one of the second voltage lines at a fourth position in the display region, and is connected to the second one of the dummy pads.

7. The display panel as claimed in claim 5, wherein:

a voltage at the first position is provided to the first one of the dummy pads through the at least one first repair line, and a voltage at the third position is provided to the second one of the dummy pads through the at least one third repair line.

8. The display panel as claimed in claim 5, wherein the at least one first repair line, the second repair lines, and the third repair line are spaced from the data lines, and extend from the peripheral region to the display region in the first direction.

9. The display panel as claimed in claim 5, wherein:

the third direction is equal to the fourth direction, and the first voltage lines are spaced from the second voltage lines.

10. A display device, comprising;

a display panel including:

a plurality of data lines extending in a first direction;

a plurality of scan lines extending in a second direction;

a pad area including a plurality of data pads connected to the data lines, and a plurality of dummy pads;

a plurality of pixel circuits connected to the data lines and the scan lines;

a plurality of light emitting devices respectively connected to the plurality of pixel circuits and to emit light by currents flowing therein;

a plurality of first voltage lines connected to the pixel circuits and to supply the currents to the light emitting devices therethrough; and a repair line group including at least one first repair line and a plurality of second repair lines, the at least one first repair line having an end connected to a first one of the dummy pads and another end directly connected to a corresponding one of the first voltage lines at a first position when a corresponding one of the pixel circuits is not defective, and the plurality of second repair lines not connected to the dummy pads and the first voltage lines;

a panel driver to apply driving signals to the data lines and the scan lines;

a power supply to apply a first power supply voltage to the first voltage lines; and a voltage level measuring circuit connected to the dummy pads and the power supply, the voltage level measuring circuit to measure a first voltage level of the first power supply voltage from the power supply, and to measure a second voltage level of the first power supply voltage from the first one of the dummy pads.

11. The display device as claimed in claim 10, wherein the display panel includes plurality of dummy pixel circuits spaced apart from the pixel circuits, the dummy pixel circuits disposed adjacent to the at least one first repair line and the second repair lines.

12. The display device as claimed in claim 10, wherein the voltage level measuring circuit is to measure, as the second voltage level of the first power supply voltage, a voltage level of the first power supply voltage at the first position through the at least one first repair line and the first one of the dummy pads.

13. The display device as claimed in claim 12, wherein the voltage level measuring circuit includes:

an analog-to-digital converter to convert the first voltage level and the second voltage level into first digital data and second digital data, respectively;

a memory to store the first digital data and the second digital data; and a microprocessor to read the first digital data and the second digital data from the memory, and to perform predetermined operations on the first digital data and the second digital data.

14. The display device as claimed in claim 13, wherein the microprocessor is to generate comparison data by comparing the first digital data corresponding to the first voltage level and the second digital data corresponding to the second voltage level, and is to provide the comparison data to the panel driver, the panel driver to compensate the driving signals based on the comparison data.

15. The display device as claimed in claim 13, wherein:

the microprocessor is to calculate a difference value between the first digital data corresponding to the first voltage level and the second digital data corresponding to the second voltage level, and is to generate a cut-off signal when the difference value is greater than a predetermined value, and the power supply is to stop supplying the first power supply voltage in response to the cut-off signal.

16. The display device as claimed in claim 12, wherein:

the display panel includes a plurality of second voltage lines to receive a second power supply voltage from the power supply, the second voltage lines connected to the light emitting devices to provide the second power supply voltage to the light emitting devices, the repair line group includes at least one third repair line having an end connected to a second one of the dummy pads and another end connected to a corresponding one of the second voltage lines at a third position.

17. The display device as claimed in claim 16, wherein the voltage level measuring circuit is to measure, as a third voltage level of the second power supply voltage, a voltage level of the second power supply voltage at the third position through the at least one third repair line and the second one of the dummy pads.

18. The display device as claimed in claim 17, wherein the voltage level measuring circuit includes:

an analog-to-digital converter to convert the second voltage level and the third voltage level to first digital data and second digital data, respectively;

a memory to store the first digital data and the second digital data; and a microprocessor to read the first digital data and the second digital data from the memory, and to perform predetermined operations on the first digital data and the second digital data.

19. The display device as claimed in claim 18, wherein:

the microprocessor is to calculates a difference value between the first digital data corresponding to the second voltage level and the second digital data corresponding to the third voltage level, and to generate a cut-off signal when the difference value is smaller than a predetermined value, and the power supply is to stop supplying the first power supply voltage and the second power supply voltage in response to the cut-off signal.

20. A display panel, comprising:

a repair line;

a pixel circuit;

a light emitting device coupled to the pixel circuit and to emit light by a current flowing therein; and a voltage line to carry a power supply voltage and to supply the current to the light emitting device therethrough, wherein the repair line is to be directly connected to the voltage line and disconnected from the pixel circuit when the pixel circuit is not in a defective state and wherein the repair line is to be disconnected from the voltage line and connected to the pixel circuit when the pixel circuit is in a defective state.

* * * * *